United States Patent [19]

Herbst et al.

[11] Patent Number: 4,488,666

[45] Date of Patent: Dec. 18, 1984

[54] TREATING AGENT DISPENSING APPARATUS FOR A WASHING APPLIANCE

[75] Inventors: LeRoy J. Herbst; John L. Preher, both of Louisville, Ky.

[73] Assignee: General Electric Company, Louisville, Ky.

[21] Appl. No.: 334,403

[22] Filed: Dec. 24, 1981

Related U.S. Application Data

[62] Division of Ser. No. 107,217, Dec. 26, 1979, Pat. No. 4,355,738.

[51] Int. Cl.[3] ..... B67D 5/08

[52] U.S. Cl. ..... 222/651; 222/504; 222/517; 134/57 D; 134/134

[58] Field of Search ..... 222/651, 652, 516, 517; 134/56 D, 57 D, 57 DL, 58 D, 58 DL, 93; 68/17 R

[56] References Cited

U.S. PATENT DOCUMENTS

| | | | |
|---|---|---|---|
| Re. 25,814 | 6/1965 | Buzicky et al. | 222/129 |
| 2,872,076 | 2/1959 | Bloom | 222/651 |
| 3,125,249 | 3/1964 | Kendt | 222/70 |
| 3,212,675 | 10/1965 | Krzewina | 222/70 |
| 3,426,944 | 2/1969 | French | 222/129 |
| 3,876,117 | 4/1975 | Wright et al. | 222/70 |
| 4,149,654 | 4/1979 | Nelson et al. | 222/70 |
| 4,149,657 | 4/1979 | Nelson et al. | 222/70 |

*Primary Examiner*—H. Grant Skaggs

*Assistant Examiner*—Frederick R. Handren

*Attorney, Agent, or Firm*—H. Neil Houser; Radford M. Reams

[57] ABSTRACT

Motor controlled dispenser apparatus for a washing appliance includes a first dispenser for storing and dispensing a first treating agent having a dispensing member movable between a closed position in which the interior of the dispenser is sealed and an open position in which the interior of the dispenser is exposed to enable the dispensing of a first treating agent; a second dispenser for storing and dispensing a second treating agent; a dispenser actuating member movable between a rest position, a first dispensing position and a second dispensing position; and a gear assembly coupling the dispenser actuating member to a motor-driven shaft, for controlling the rate of movement of the dispenser actuating member in accordance with the rate of rotation of the shaft. The dispensing member is coupled to the dispenser actuating member for movement therewith. The rate of movement of the dispensing member from its closed to its open position being determined by the rate of rotation of the motor-driven shaft. The dispenser actuating member in moving from its first to its second dispensing position places the second dispenser in condition for dispensing the second treating agent. The dispenser actuating member is returned to its rest position by user movement of the dispensing member to its closed position.

9 Claims, 8 Drawing Figures

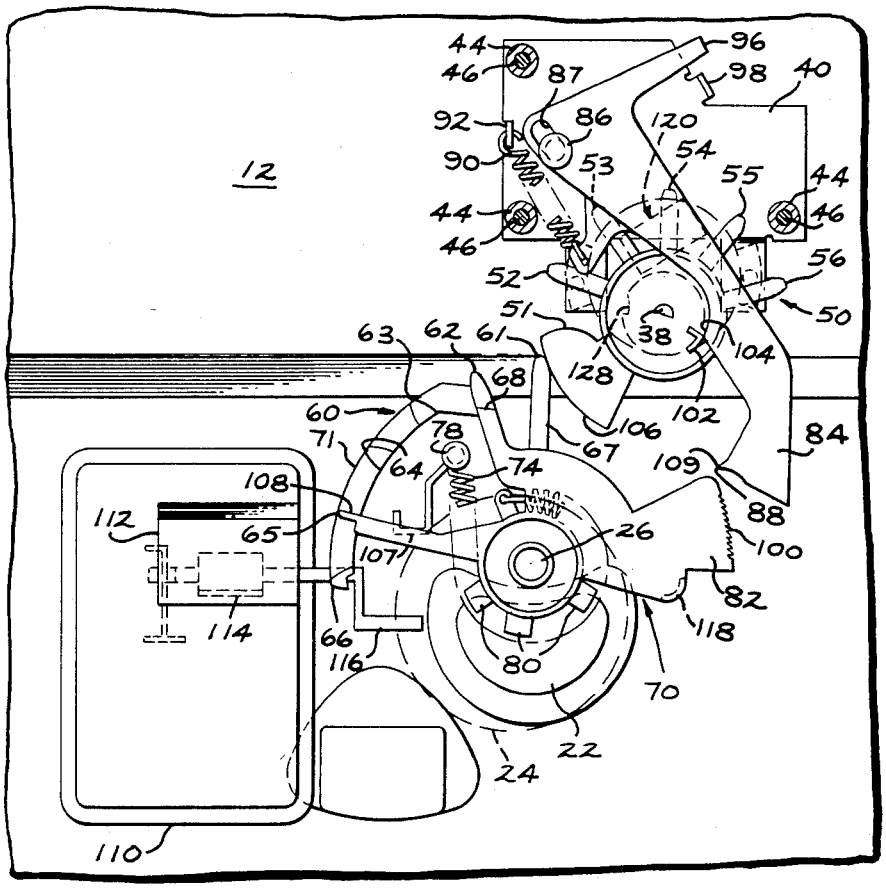
FIG. 4
FIG. 5
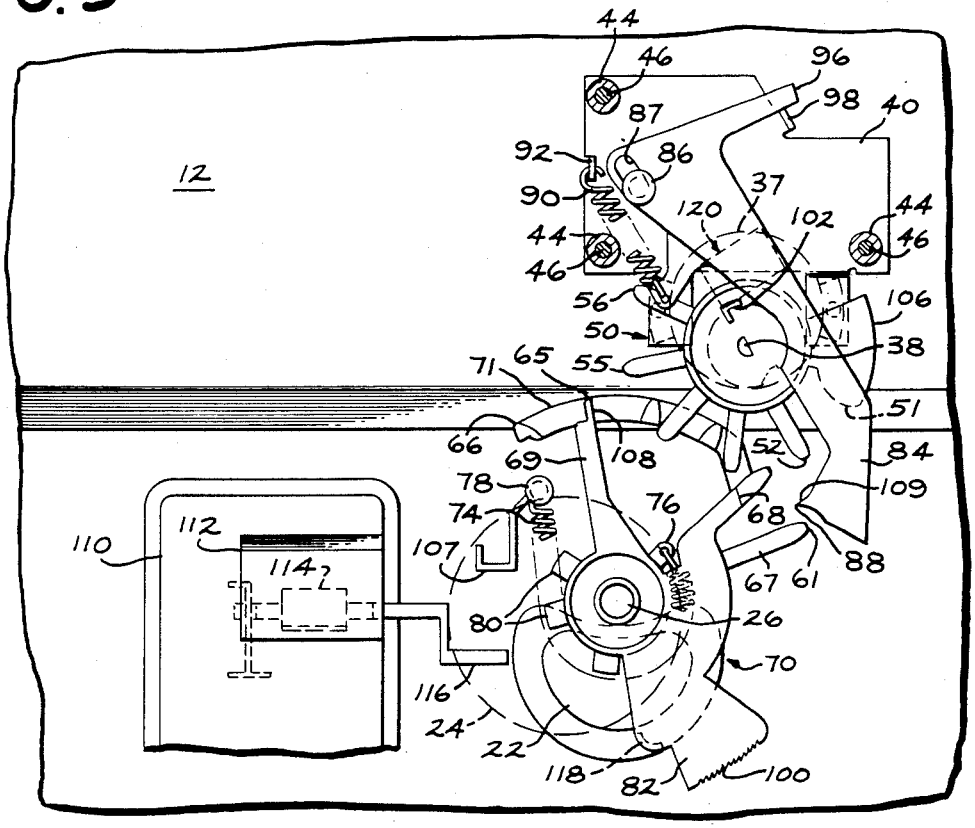

TREATING AGENT DISPENSING APPARATUS FOR A WASHING APPLIANCE

This is a division of application Ser. No. 06/107,217, filed Dec. 26, 1979, now U.S. Pat. No. 4,355,738.

BACKGROUND OF THE INVENTION

This invention relates generally to treating agent dispensers and more specifically to treating agent dispenser apparatus adapted for use in an automatic washing appliance.

Means for automatically dispensing treating agents such as detergents and rinse aid are normally provided in automatic washing appliances. Such treating agents must be dispensed during specific and different phases of the operating cycle of the appliance. For example, in an automatic dishwasher, detergent is dispensed early in the washing operation, whereas rinse aid is dispensed early in the final rinse cycle. Automatic dispensers which operate in preselected timed sequence to dispense such additives have been provided in the past. Typically, such dispensers are spring loaded to their open or dispensing position. The user places the additive in the dispenser, then overcomes the spring force in closing the cup which is held in its closed position by a mechanical latch. The dishwasher sequence controller releases the mechanical latch at the appropriate time in the operating cycle and the cup is snapped open by the force of the spring. One problem with such dispensing apparatus is that the rapid movement associated with opening the dispenser is noisy. Thus, a method for reducing the noise associated with operation of the dispensing apparatus is desirable.

It is therefore an object of the present invention to provide dispensing apparatus for an automatic washing appliance in which the rate of movement of the dispensing apparatus in dispensing treating agents contained therein is controlled for a quiet operation.

It is a further object of the present invention to provide dispensing apparatus for an automatic washing appliance in which the rate of movement of the dispenser is controlled by a gear drive arrangement.

It is a further object of the present invention to provide dispensing apparatus for sequentially dispensing multiple additives, in which the means for dispensing the first treating agent is moved to its dispensing position in concert with the movement of a driving motor and the means for dispensing the second additive is moved to its dispensing position in response to subsequent driving motor operation.

It is a further object of the present invention to provide dispensing apparatus which includes two separate dispensing means sequentially operated by a dedicated dispenser motor.

SUMMARY OF THE INVENTION

An automatic washing appliance is provided with motor controlled dispenser apparatus for dispensing treating agents into the wash chamber of the appliance at appropriate times in the operating cycle as determined by a sequence control means. The dispensing apparatus includes first and second dispensing means for receiving, containing, and dispensing first and second treating agents respectively. The first dispensing means includes a dispensing member movable between an open position and a closed position. In its closed position, the dispensing member seals the interior of the first dispensing means from the wash chamber. The first treating agent is dispensed by movement of the first dispensing member to its open position.

Movement of the dispensing member is controlled by dispenser actuating means movable between a rest position and first and second dispensing positions. The dispenser actuating means is mechanically linked to a motor driven shaft such that the rate of movement of the dispenser actuating means from its rest position to its first dispensing position is determined by the rate of rotation of the drive shaft. The dispensing member is coupled to the dispenser actuating means for movement in concert therewith. The closed and open positions of the dispensing member correspond to the rest and first dispensing positions of the dispenser actuating means, respectively. Bias means urges the dispenser actuating means toward its first dispensing position. Gear means coupling the dispenser actuating means to the drive shaft oppose the bias means to control the rate of movement of the dispenser actuating member in accordance with the rate of rotation of the drive shaft.

Retaining means engages and yieldably retains the dispensing actuating means in its rest position. During a first revolution of the drive shaft, the retaining means releases the dispenser actuating means for movement from its rest position and then re-engages and retains the dispenser actuating means in its first dispensing position. During the next successive revolution of the drive shaft, the retaining means releases the dispensing means for movement to its second dispensing position. Movement of the dispenser actuating means from its first to its second dispensing position places the second dispensing means in condition for dispensing the second treating agent. The dispenser actuating means is returned to its rest position by user movement of the dispensing member to its closed position after addition of a quantity of first treating agent in preparation of the dispensing apparatus for the next appliance operating cycle.

The subject matter regarded as the present invention is particularly pointed out and distinctly claimed in the concluding portion of this specification. The invention, together with further objects and advantages thereof, however, may best be understood by reference to the following description taken in connection with the accompanying drawings.

BRIEF DESCRIPTION OF THE DRAWINGS

FIGS. 4–7 are views similar to FIG. 2 but showing the dispensing apparatus of the illustrative embodiment in various different conditions of operation.

DETAILED DESCRIPTION OF THE INVENTION

The dispensing apparatus of the present invention is generally useful in washing appliances, particularly automatic dishwashers, to automatically dispense treating agents into the wash chamber at appropriate times in the appliance operating cycle.

The illustrative embodiment of the subject invention to be described herein incorporates the dispensing apparatus of the present invention in a dishwasher to dispense a first treating agent, namely a granular detergent, and a second treating agent, namely a liuqid rinse aid additive at appropriate times in the dishwasher operating cycle as determined by the electronic sequence controller.

Figure 1:
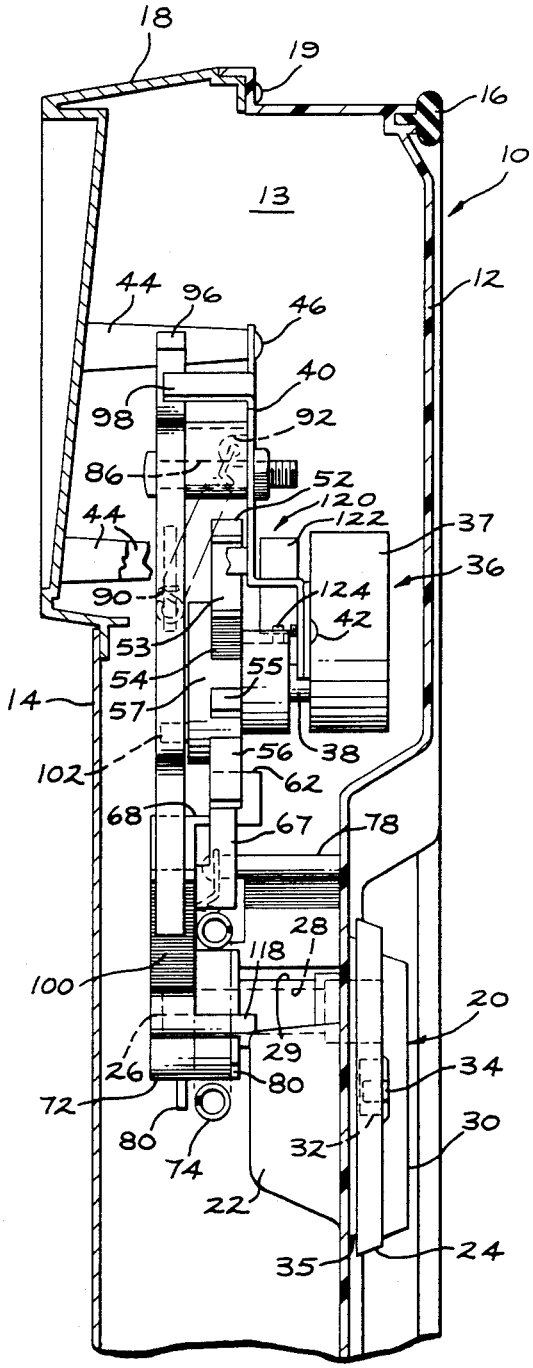
FIG. 1 is a fragmentary sectioned view of a door for an automatic dishwasher having mounted thereon an illustrative embodiment of the dispenser apparatus of the present invention.

Referring now to the drawings and particularly to FIG. 1 thereof, there is illustrated the upper portion of a dishwasher door 10 which is designed to be pivotally secured to a dishwasher cabinet (not shown) for movement between a generally vertical closed position and a generally horizontal open position. Such dishwasher doors are conventional and one of such doors is described in greater detail in U.S. Pat. No. 4,149,654 to Thomas E. Nelson et al. and assigned to General Electric Company, the assignee of the present invention. Door 10 has an inner door wall 12 and an outer door wall 14 defining therebetween a chamber 13. Inner wall 12 faces the wash chamber of the dishwasher when door 10 is in the closed position. Door gasket 16 is secured to the periphery of the inner door wall for sealing engagement with the cabinet when door 10 is in the closed position. Escutcheon frame 18 is secured at its upper edge to the upper portion of inner wall 12 and at its lower edge to the upper portion of outer wall 14 by suitable fastening means such as screws 19.

In this illustrative embodiment, a substantial portion of the dispensing apparatus of the present invention is contained within the enclosure of chamber 13. This dispensing apparatus includes a first dispensing means designated generally by numeral 20 for storing and dispensing a first treating agent, preferably a granular detergent. Dispensing means 20 comprises a generally semispherical container 22 formed in wall 12 of dishwasher door 10, and a movable dispensing member, cover 24, mounted to and adapted for rotation with a dispenser shaft 26. Shaft 26 is journalled in an opening 28 in hub 29 formed in the dishwasher inner door wall 12 adjacent container 22. One end portion of shaft 26 extends into chamber 13, the other end portion extends through cover 24 having a handle portion 30 formed integrally thereon. Cover 24 and handle 30 are interconnected by means of a slot 32 formed in cover 24 and a pin 34 projecting from handle 30. Both the slot 32 and pin 34 are inclined to provide a camming action between the slot and the pin which forces cover 24 into sealing engagement with a circumferential lip 35 formed in inner door wall 12 encompassing container 22 when handle 30 is moved in a clockwise direction, as seen facing the interior wall 12. When handle 30 is moved in a counterclockwise direction, the interaction of pin 34 with slot 32 moves cover 24 axially away from door panel 12. Thus, cover 24 is movable between a closed position shown in FIG. 1 and also in phantom in FIG. 2 and an open position as seen in phantom in FIG. 6. It will be understood that in its closed position cover 24 seals container 22 from the interior of the wash chamber thereby storing the treating agent and that in its open position cover 24 exposes the interior of container 22 to the interior of the dishwasher. In this open position, the interior of container 22 is exposed to the spray of washing liquid being circulated in the wash chamber during a wash cycle and thus dispensing means 20 with cover 24 in this position enables dispensing of the washing detergent contained in container 22. The structure and operation of dispenser 20 is described in greater detail in U.S. Pat. No. 4,149,657 to Nelson et al. and assigned to General Electric Company, the disclosure of which is incorporated herein by reference.

In accordance with the present invention, the rate of rotation of the dispensing member, cover 24, from its closed to its open position is determined by the rotation rate of a motor driven drive shaft. In the illustrative embodiment, a dedicated dispenser motor 36 is provided for controlling operation of the dispensing apparatus, including movement of cover 24. Motor 36 is mounted in chamber 12 by screws 42 which secure motor housing 37 to mounting bracket 40 which in turn is secured to bosses 44 projecting from escutcheon frame 18 by screws 46.

Figure 2:
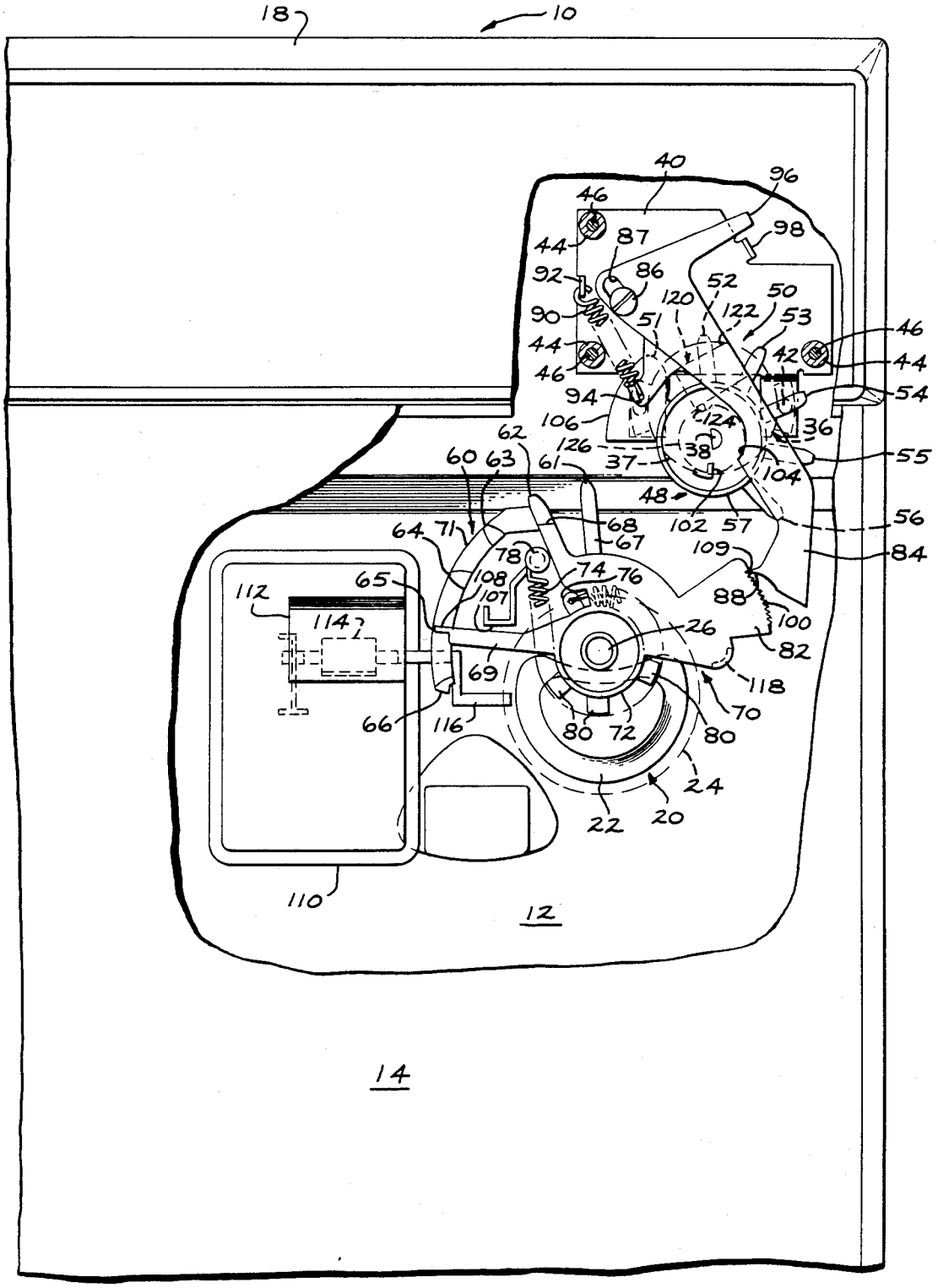
FIG. 2 is a front elevational view of the dishwasher door of FIG. 1 with portions broken away to show the dispenser apparatus of the illustrative embodiment.
Figure 3:
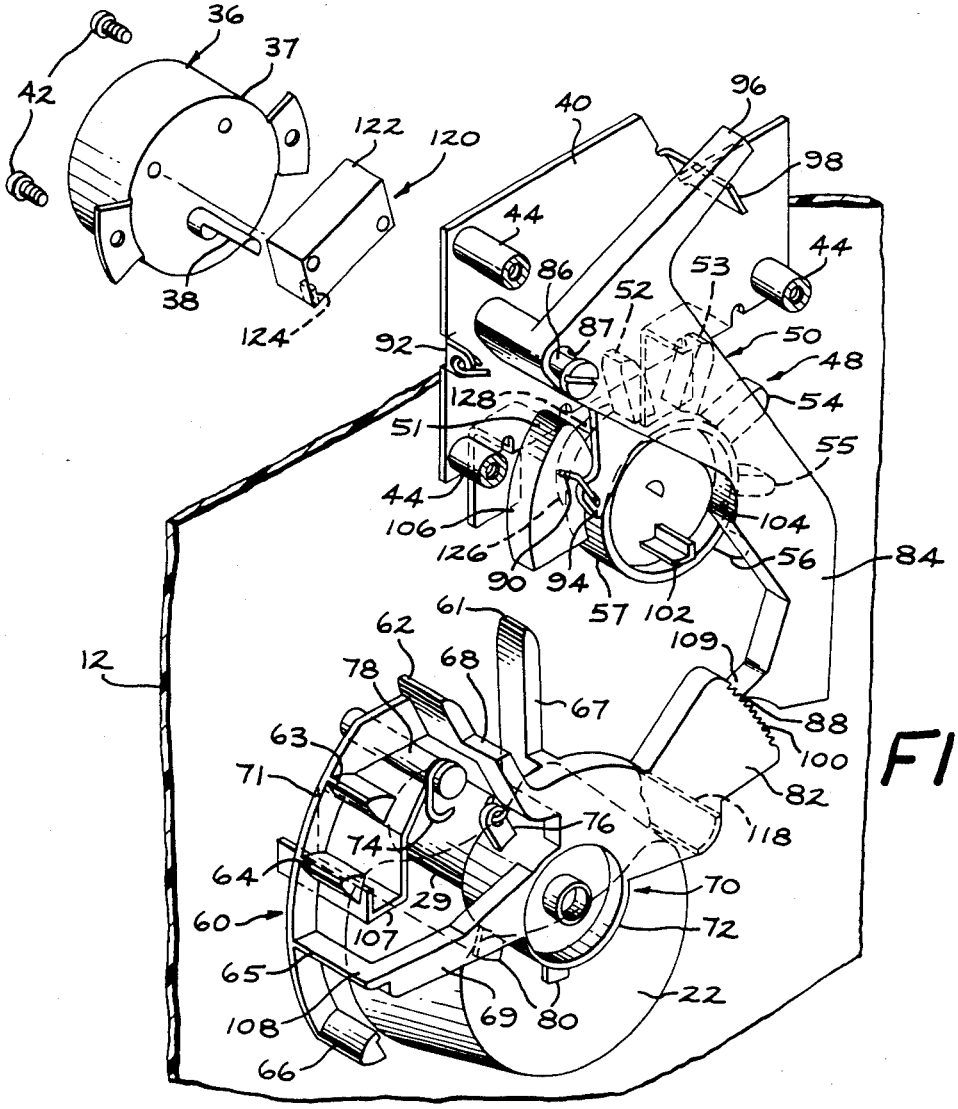
FIG. 3 is a partially exploded perspective view of the dispensing apparatus of the illustative embodiments of FIG. 2.

Output drive shaft 38 of motor 36 projects from housing 37. The rate of rotation of cover 24 is determined by the rate of rotation at which output drive shaft 38 is driven by motor 36. As best seen in FIGS. 2 and 3, linking means for controllably linking drive shaft 38 to cover 24 and effective to control the rate of movement of dispensing member, cover 24, from its closed to its open position in accordance with the rate of rotation of drive shaft 38 is provided in the form of driving gear means, designated generally 48, suitably secured to drive shaft 38 for rotation therewith, and dispensing gear means, designated generally 60, formed integrally with dispenser actuating means, designated generally 70, which is suitably secured to shaft 26 for rotation therewith.

Driving gear means 48 comprises a segmental gear 50 having a plurality of driving gear teeth 51 through 56 projecting radially from a substantially circular member 57 which is press fit to drive shaft 38. Dispensing gear means 60 comprises a plurality of dispensing gear teeth 61 through 66. Teeth 61, 62 and 65 are formed on the distal ends of radial members 67, 68 and 69 which project radially from circular member 72 of dispenser actuating means 70. Circular member 72 is press fit to dispensing shaft 26. Teeth 63, 64 and 66 are formed on an arcuate cross member 71 which joins radial members 68 and 69. Driving gear means 48 and dispensing gear means 60 are constructed and arranged such that driving gear teeth 51 through 56 successively meshingly engage corresponding gear teeth 61 through 66 as drive shaft 38 rotates thereby controlling the rate of rotation of shaft 26 and thus the movement of cover 24 from its closed position to its open position in accordance with the rate of rotation of drive shaft 38.

In order to permit the user to manually rotate cover 24 between its open and closed position without rotating drive shaft 38, segmental gear 50 is constructed and arranged to have an idle position in which the driving gear teeth are disengaged from and completely out of the path of the dispensing gear teeth, as shown in FIG. 2. With segmental gear 50 in this position, cover 24 may be manually moved by the user from its open to its closed position without engagement of segmental gear 50 by dispensing gear means 60.

Cover 24 is biased away from its closed position by spring 74 to prevent cover 24 from partially or fully returning to its closed position when segmental gear 50 disengages dispenser gear means 60 and returns to its idle position after having moved cover 24 to its open position. This prevents cover 24 from interfering with dispensing of the washing agent contained therein.

Spring 74 is an extension spring secured at one end to tab 76 formed on the periphery of circular member 72 and secured at its other end to boss 78 formed in inner wall 12. Spring 74 wraps around circular member 72 between alternating spaced apart guiding tabs 80 which project radially from member 72 to position spring 74 around member 72.

Means must be provided for yieldably retaining cover 24 in its closed position in opposition to spring 74 when cover 24 is moved to its closed position by the user, such as after container 22 has been filled with detergent since segmental gear 50 is in its idle position. This means is provided by a movable retainer arm 84 which engages a first latching member 82 extending from dispenser actuating means 70 to retain cover 24 in its closed position. Retainer arm 84 is pivotally mounted at one end to mounting bracket 40 by pin 86 received in elongated slot 87. A pawl 88 is formed at its other end. At rest, retaining arm 84 assumes a latching position shown in FIG. 5 in which extension 96 of retaining arm 84 abuts stop 98 projecting from bracket 40. In this latching position, pawl 88 projects into the path of latching member 82. Spring 90, secured at one end to tab 92 formed in bracket 40 and at its other end to extension 94 of retaining arm 84 biases retaining arm 84 toward its latching position. For reasons to be described spring 90 and elongated slot 87 are substantially parallel. Retaining arm 84 is effective in its latching position to engage and retain the distal end of latching member 82 when cover 24 is moved to its closed position. A plurality of teeth 100 are formed at the distal end of latching member 82 extending radially therefrom. Teeth 100 are formed to oppose clockwise rotation of member 82 (as viewed in FIG. 2) when engaged by pawl 88 thereby facilitating yieldable retention of latching member 82 by retaining arm 84.

Counterclockwise rotation (as viewed in FIGS. 2 and 7) of cover 24 by the user from its open position to its closed position moves latching member 82 into engagement with retaining arm 84. Member 82 is retained in this position following user release of cover 24 by the interaction of pawl 88 and teeth 100. The retention of cover 24 by arm 84 is yieldable in the sense that the user can override the retaining force of pawl 88 by clockwise rotation of cover 24 from its closed position toward its open position if desired. As best seen in FIG. 2, clockwise movement of cover 24 moves teeth 100 in a clockwise direction. Clockwise movement of teeth 100 moves pawl 88, and consequently retainer arm 84 generally translationally, in a direction which substantially parallels elongated slot 87, in opposition to spring 90. Retainer arm 84 continues to be moved in this direction by teeth 100 until extension 96 abuts stop 98 which limits further translational movement of retainer arm 84 away from its latching position. Further movement of pawl 88 by teeth 100 pivots arm 84 in a counterclockwise direction thereby moving pawl 88 from and out of latching engagement with teeth 100, permitting manual opening of cover 24.

During normal operation, cover 24 is released for movement from its closed to its open position automatically at the appropriate time in the appliance operating cycle by release means operatively coupled to drive shaft 38. This release means is effective to move retaining arm 84 away from its latching position, disengaging retaining arm 84 from latching member 82 as segmental gear 50 moves away from its idle position, thereby releasing cover 24 for movement to its open position. In the illustrative embodiment this release means includes cam member 102 operatively coupled to drive shaft 38 for rotation therewith. Cam member 102 is formed integrally with and projects axially from circular member 57. Retaining arm 84 includes a cam surface 104 formed along a portion of its length facing cam member 102. Cam member 102 is operative to engage cam surface 104 to move retaining arm 84 away from its latching position as drive shaft 38 rotates segmental gear 50 away from its idle position thereby releasing cover 24 for movement to its open position. As best seen in FIG. 4, counterclockwise rotation of segmented gear 50 rotates cam member 102 into engagement with cam surface 104. As gear 50 continues to rotate, cam member 102 slides along cam surface 104 and pivots pawl 88 away from and out of engagement with latching teeth 100. Disengagement of pawl 88 from teeth 100 releases latching member 82 and consequently releases dispenser actuating means 70 for rotation toward a first dispensing position corresponding to the open position of cover 24 responsive to biasing force of spring 74.

As segmental gear 50 rotates from its idle position, rotating cam member 102 toward cam surface 104 of retaining arm 84, gear tooth 51 is rotating into position for engaging dispensing gear tooth 61. Gear tooth 51 is provided with an elongated cam surface portion 106 for intially engaging dispensing gear tooth 61 to assure proper meshing of the driving gear teeth with the dispensing gear teeth. Cam surface 106 compensates for manufacturing and assembly tolerances which result in variations in the angular position of segmental gear 50 at the time of release of latching member 82 by retaining arm 84.

Figure 6:
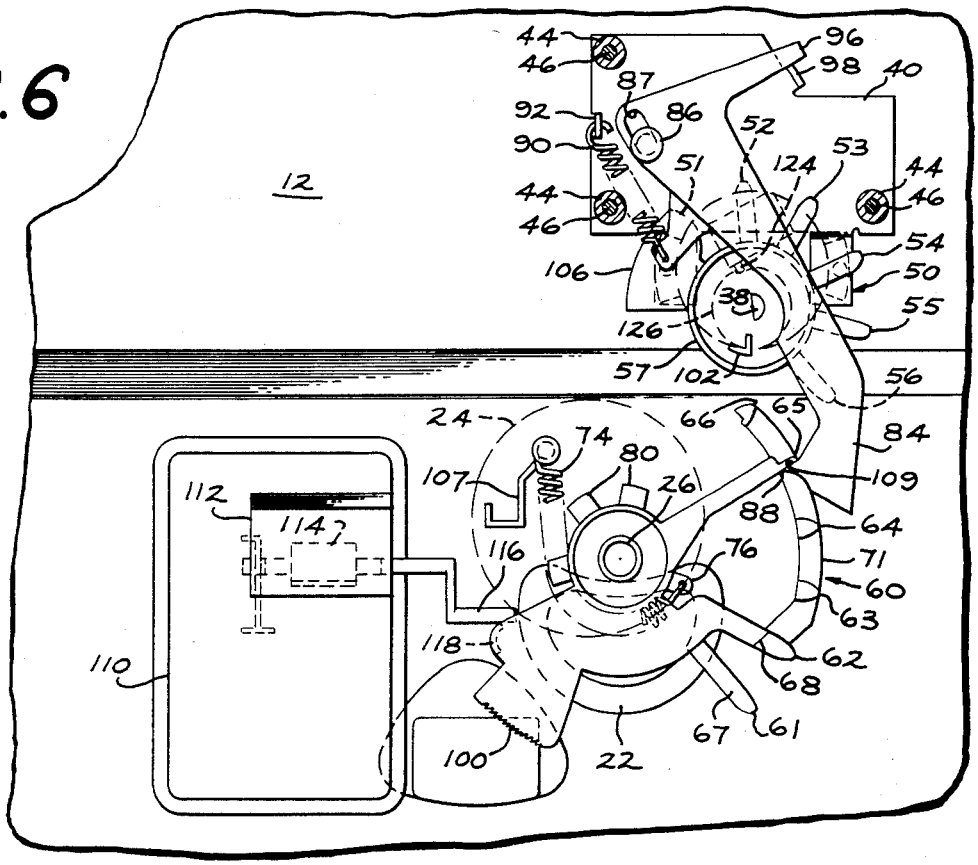

FIG. 5 shows the position of various dispensing apparatus elements after approximately one-half revolution of drive shaft 38. It can be seen that container 22 is partially exposed and that cam member 102 has disengaged from retaining arm 84 permitting it to return to its latching position. FIG. 6 shows segmental gear 50 in its idle position after completion of a first revolution of drive shaft 38. At this time, cover 24 is in its open position in which the interior of container 22 is exposed to the interior of the wash chamber; and dispensing means 70 is in its first dispensing position. If the dispensing of a single treating agent is all that is required, movement of cover 24 could be retained in its open position by suitable stationary stop means. However, in accordance with one aspect of the present invention, capability for sequentially dispensing two treating agents is provided. To facilitate a second dispensing operation, retaining arm 84 is operative in its latching position to engage and retain dispenser actuating means 70 in its first dispensing position by retainably engaging second latching member 108 which is preferably formed integrally with radial member 69 which projects radially from circular member 72 of dispenser actuating means 70. As best seen in FIG. 3, second latching member 108 comprises an extension of gear tooth 65 which extends axially into alignment with retaining arm 84 so that as the last segmental gear tooth 56 moves out of engagement with the last dispenser gear tooth 66, latching member 108 engages latching surface 109 formed contiguous with pawl 88. Retaining arm 84 retains dispenser actuating means 60 in its first dispensing position until the sequence control means calls for the dispensing of the second treating agent at which time motor 36 is energized to rotate segmental gear 50 out of its idle position. As segmental gear 50 is moved from its idle position, cam member 102 is moved into engagement with retaining arm 84. During this next successive revolution, cam member 102 is effective to move retaining arm 84 out of engagement with second latching member 108. This releases dispenser actuating means 60 for further rotational movement to a second dispensing position shown in FIG. 7. Stop 107 formed integrally with and projecting from inner wall 12 prevents dispenser actuating means 60 from further clockwise rotation from its second dispensing position. In the illustrative embodiment, movement of the actuating means 70 from its first dispensing position to its second dispensing position is an unrestrained movement in response to spring 74. This unrestrained movement is substantially less noisy than similar movement for opening cover 24 because the distance travelled is much less. However, it is apparent that further noise reduction could be achieved by employing additional dispensing gear teeth to provide gear drive control of the movement of dispenser actuating means 70 from its first dispensing position to its second dispensing position in the same manner as its movement from the closed position to the first dispensing position is controlled.

Figure 7:
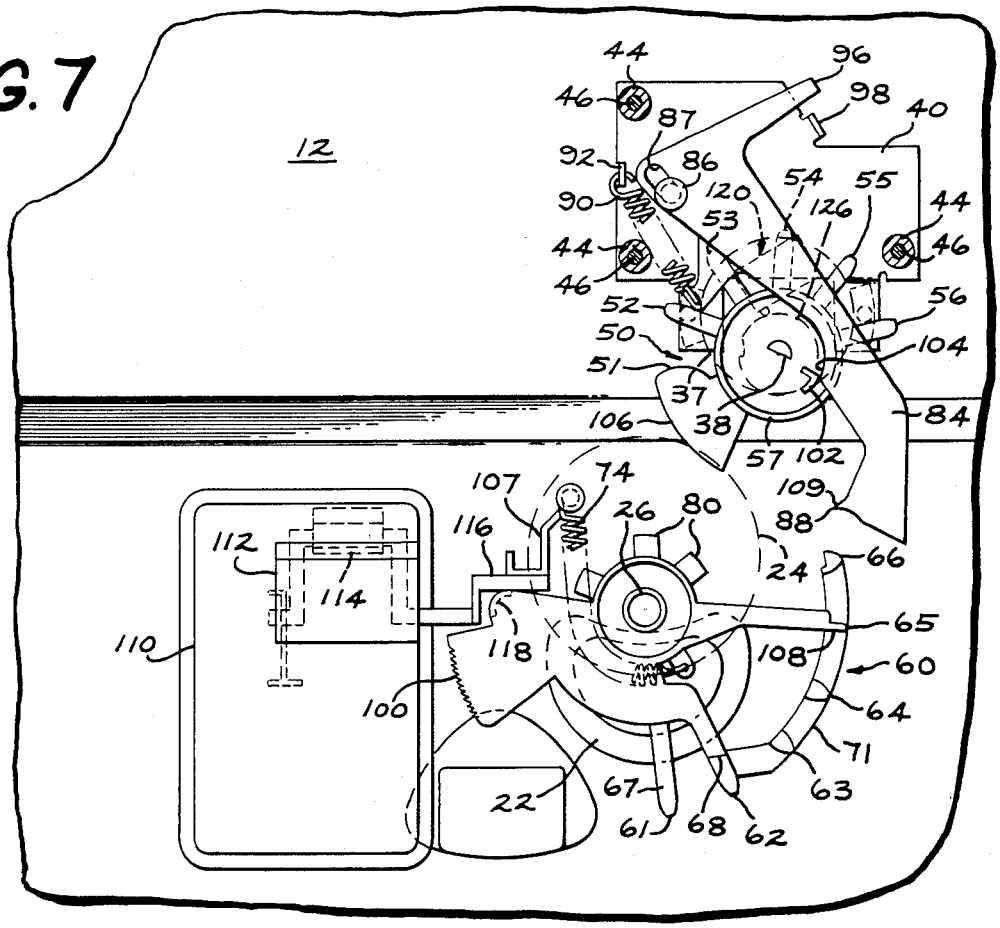

In accordance with the sequential dispensing aspect of the present invention, a second dispensing means for receiving, containing and dispensing a second treating agent is provided. The second dispensing means is operative to dispense a second treating agent in response to movement of dispenser actuating means 70 to its second dispensing position. In the illustrative embodiment, the second dispensing means comprises a generally rectangular container 110 for receiving a liquid treating agent such as a rinse aid additive arranged to be mounted within chamber 13 by any suitable means. Container 110 includes a sump 112 located in the portion of container 110 closest to the outer door wall 14 such that when dishwasher door 10 is in its open position sump 112 is in the lowest portion of the liquid additive reservoir defined by container 110. Liquid additive is charged to the container 110 through a fill opening (not shown) which protrudes from the inner wall 12 of door 10. The fill opening is fitted with a closure device (not shown) to prevent leakage of water into container 110 during operation of the dishwasher and to prevent leakage of additive into the dishwasher. A measuring and dispensing cup 114 of a predetermined size is rotatably mounted for movement between a filling position shown in phantom in FIG. 6 and a discharge position shown in phantom in FIG. 7 by means of a pivot arm 116 which projects from container 110. In the filling position cup 114 is positioned within sump 112 for submergence in liquid additive when the dishwasher door 10 is in its open position. Upon closing the dishwasher door, container 110 is rotated through approximately 90° causing the liquid additive in sump 112 to flow to the lower portion of container 110. However, cup 114 retains a precise quantity of liquid additives. As dispenser actuating means 60 moves from its first dispensing position shown in FIG. 6 to its second dispensing position shown in FIG. 7, extension 118 formed integrally with and projecting axially from first latching member 82 engages pivot arm 116 and moves it into abutting engagement with stop 107 as shown in FIG. 7, causing measuring cup 114 to move to its discharge position in which liquid retained in the measuring cup is discharged into a discharge conduit which communicates with the interior of the wash chamber. Thus, dispenser actuating means 70 is operative in its second dispensing position to place the second dispensing means in a position in which the second dispensing means is operative to dispense the second treating agent. A more detailed description of the second dispensing means used in the illustrative embodiment is provided in U.S. Pat. No. 4,149,656 to Thomas E. Nelson, assigned to the General Electric Company, the disclosure of which is hereby incorporated by reference. It will be apparent that numerous alternate dispensing means could be employed without departing from the present invention provided only that dispensing be initiated by movement of dispensing means 70 in moving from its first to its second dispensing position.

Control means for the dispenser motor is now described. Referring again to FIGS. 1 and 3, a snap action switch for controlling energization of motor 36, designated generally 120 is provided. Switch 120 includes a housing 122 secured to the housing of motor 36 by suitable means such as by screws (not shown). A push-button actuator 124 projects from switch housing 122 generally in the direction of drive shaft 38. Switch actuating means for actuating switch 120 comprises an annular cam surface 126 formed integrally with circular member 57 concentric with drive shaft 38 and having a radial groove portion 128 formed therein. Groove 128 is positioned relative to segmental gear 50 such that groove portion 128 is aligned with actuator 124 of switch 120 when the segmental gear is in its idle position as best seen in FIG. 6. Cam surface 126 is operative to depress actuator 124 thereby actuating the switch 120 when actuator 124 engages the annular cam surface portion 126 and to deactuate switch 120 by releasing actuator 124 from its depressed position when the actuator is aligned with groove 128. Actuator 124 is biased outwardly by internal bias means not shown.

Figure 8:
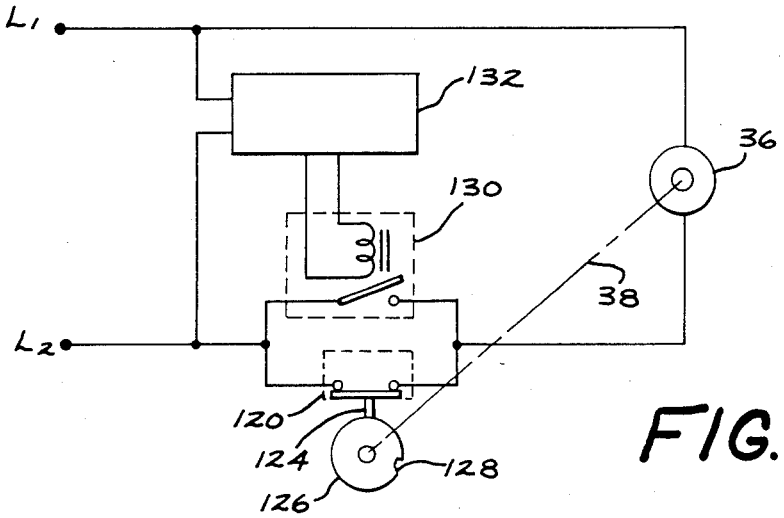
FIG. 8 is a schematic circuit diagram illustrating the dispenser apparatus control circuit employed in the illustrative embodiment of FIG. 2.

The control circuit for the dispensing actuating means of the present invention will be described with reference to the schematic circuit diagram of FIG. 8. Power lines $L_1$ and $L_2$ are adapted for connection to an external power supply which is typically a 115 volt AC household supply. A first switch means 130 is electrically connected in parallel with a second switch means comprised of snap action switch 120. This parallel combination of switches 120 and 130 is connected in series with dispenser motor 36 and power lines $L_1$ and $L_2$ to control energization of motor 36. Switch means 130 is preferably a relay switch adapted for actuation by sequence controller 132.

During the major portion of the appliance operating cycle, switches 120 and 130 are deactuated, that is, in their open positions, and motor 36 is de-energized. At the appropriate time in the appliance operating cycle for dispensing the first treating agent, as determined by sequence controller 132, sequence controller 132 generates a signal which actuates switch 130, switching it to its closed position. This energizes motor 36 which rotates drive shaft 38 thereby moving segmental gear 50 away from its idle position. As segmental gear 50 moves away from its idle position, switch actuating cam surface 126 rotates in a counterclockwise direction as seen in FIG. 8, depressing switch actuator 124 as groove 128 moves out of alignment with actuator 124 and surface 126 engages actuator 124. At this point, switches 120 and 130 are both actuated. After a period of time sufficient to allow actuation of switch 120 by surface 126 but less than the time required for segmental gear 50 to return to its idle position, sequence controller 132 deactuates switch 130. However, motor 36 continues to be energized through switch 120 until segmental gear 50 returns to its idle position at which time groove 128 is again aligned with and receives switch actuator 124 thereby deactuating switch 120. Thus, the control circuit of FIG. 8 is effective to enable sequence controller 132 to initiate energization of motor 36 at the desired times in the appliance operating cycle and to de-energize motor 36 in response to the angular position of the drive shaft such that the segmental gear 50 and thus dispenser actuating means 60 always stop in the same angular position at the end of each revolution of drive shaft 38.

Operation of the dispensing apparatus during a complete appliance operating cycle will now be described. Initially, dispenser actuating means 70 will be in its second dispensing position shown in FIG. 7 having been placed in that position during the previous use of the appliance or by the user by manual manipulation of cover 24. Cover 24 will be held in the position shown in FIG. 7 by spring 74 exposing the interior container 22. After placing washing detergent in container 22 the user manually moves cover 24 to its closed position shown in FIG. 2. Movement of cover 24 to its closed position rotates dispenser actuating means 70 to its rest position shown in FIG. 2. As dispenser actuating means approaches its rest position, pawl 88 of retainer arm 84 engages teeth 100 of latching member 82. Cover 24 is held in its closed position by the engagement of retainer arm 84 with first latching member 82. At the appropriate time for dispensing the detergent, sequence controller 132 actuates switch 130 to energize dispenser motor 36. Segmental gear 50 is rotated by motor 36 in a counterclockwise direction away from its idle position. As segmental gear 50 rotates in a counterclockwise direction away from its idle position, cam member 102 engages and pivots retainer arm 84 to move pawl 88 out of engagement with latching member 82 permitting clockwise rotation of dispenser actuating means 70 under the influence of biasing spring 74. This rotation brings tooth 61 of dispensing gear 60 into engagement with surface 106 of tooth 51 of segmental gear 50 as shown in FIG. 4. As segmental gear 50 continues to rotate gear teeth 51 through 56 successively engage corresponding dispenser gear teeth 61 through 66. FIG. 5 shows the approximate position of the various components midway through a revolution of drive shaft 36. Dispenser actuating means 70 continues to rotate under the control of segmental gear 50 until dispenser actuating means 70 is moved to its first dispensing position shown in FIG. 6. When dispenser actuating means 70 rotates to this position, latching surface 109 of retaining arm 84 engages second latching member 108 and retains dispenser actuating means 70 in this position. Segmental gear 50 continues to rotate until returning to its idle position at which time switch 120 is deactuated by switch actuating member 124. In this position dispenser actuating means 70 has moved cover 24 to its open position shown in FIG. 6 exposing the interior of container 22 to the interior of the washing appliance wash chamber, thereby dispensing the washing detergent contained therein. The various components remain in the position shown in FIG. 6 until sequence controller 132 calls for dispensing the second additive. At that time, sequence controller 132 again actuates switch 130 energizing motor 36 to move cam member 102 into engagement with retainer arm 84. Cam member 102 engages cam surface 104 of retainer arm 84 and pivots latching surface 109 out of engagement with second latching member 108, releasing dispenser actuating means 70 for clockwise rotation from its first dispensing position (FIG. 6) to its second dispensing position (FIG. 7). As dispenser actuating means 70 moves from its first to its second dispensing position, actuating extension 118 moves pivot arm 116 thereby pivoting cup 114 to its dispensing position thereby dispensing a measured amount of the rinse aid additive into the wash chamber of the appliance. Segmental gear 50 continues to rotate until it returns to its idle position where switching actuator 124 is received in groove 128 deactuating switch 120 and de-energizing motor 36.

The foregoing description has been directed to a particular embodiment of the present invention. However, it will be apparent to those skilled in the art that certain aspects of the invention are not limited to the particular details of construction of the illustrative embodiment described herein and it is contemplated that various modifications will occur to those skilled in the art. For example, rather than providing a motor dedicated strictly to controlling movement of the dispensing apparatus, the rotational motion provided by the dispensing motor in the illustrative embodiment could be obtained from the timer motor of a conventional sequence controller wherein the driving gear means of the illustrative embodiment is linked to the drive shaft of the timer motor by a gear train. It is therefore intended that the appended claims shall cover such modifications and applications as do not depart from the true spirit and scope of the invention.

What is claimed is:

1. Dispensing apparatus for dispensing treating agents into the wash chamber of an automatic washing appliance having sequence control means for controlling the sequence of operation of the appliance, said dispensing apparatus comprising:

dispensing means to store and dispense a treating agent;

said dispensing means including a dispensing member adapted to move between a closed position storing the treating agent and an open position enabling dispensing of the treating agent;

a motor and a drive shaft adapted for rotation by said motor;

driving gear means comprising a plurality of driving gear teeth, said driving gear means being coupled to said drive shaft for rotation therewith;

dispensing gear means comprising a plurality of dispensing gear teeth, said dispensing gear means being coupled to said dispensing member for movement of said dispensing member therewith;

biasing means for biasing said dispensing member toward its open position, said biasing means being operative to urge said dispensing gear teeth into engagement with said driving gear teeth;

said driving gear teeth being arranged to successively engage corresponding ones of said dispensing gear teeth as said drive shaft rotates; thereby permitting said biasing means to move said dispensing member toward its open position at a rate determined by the rate of rotation of said drive shaft.

2. The dispensing apparatus of claim 1 wherein said driving gear teeth are part of a segmental gear having an idle position in which said driving gear teeth are disengaged from said dispensing gear teeth, and wherein said apparatus further comprises:

retaining means for yieldingly retaining said dispensing member in its closed position including:

a latching member coupled to said dispensing member for movement therewith;

a movable retaining arm having a latching position, said retaining arm being biased toward its latching position and effective in its latching position to engage and retain said latching member when said dispensing member is in its closed position;

release means operatively coupled to said drive shaft and effective to move said retaining arm away from its latching position thereby disengaging said retaining arm from said latching member as said segmental gear moves away from its idle position thereby releasing said dispensing member for movement to its open position.

3. The dispensing apparatus of claim 2 wherein a one of said plurality of driving gear teeth includes an elongated cam surface which is moved into engagement with a corresponding one of said dispensing gear teeth as said segmental gear moves from its idle position to assure proper meshing of said driving gear teeth with said dispensing gear teeth.

4. The dispensing apparatus of claim 3 further comprising arm biasing means effective to urge said retaining arm toward its latching position; and wherein:

said release means comprises a cam member operatively coupled to said drive shaft for rotation therewith; and said retaining arm includes a cam surface along a portion of its length;

said cam member being operative to engage said retaining arm cam surface to move said retaining arm away from its latching position as said drive shaft rotates said segmental gear away from its idle position thereby releasing said dispensing member for movement to its open position.

5. The dispensing apparatus of claim 3 further comprising:

a rotating dispenser shaft; said dispensing member, said dispensing gear means and said latching member each being secured to said dispenser shaft for rotational movement therewith, said dispensing member being rotatably movable between its open and closed positions.

6. The dispensing apparatus of claim 5 wherein said dispensing means further comprises a container for receiving the treating agent and wherein said dispensing member comprises a cover; said cover sealing said container when in its closed position and exposing said container when in its open position, said container being operative to dispense the treating agent received therein when exposed.

7. The dispensing apparatus of claim 2 further comprising first switch means responsive to the sequence control means for initiating energization of said motor; and second switch means responsive to rotation of said drive shaft for terminating energization of said motor.

8. The dispensing apparatus of claim 7 further comprising a switch actuating member secured to said drive shaft for rotation therewith; and wherein said first and second switch means are connected in parallel, the parallel combination being connected in series with said dispenser motor, each of said switch means being operative when actuated to connect said dispenser motor to an external power supply;

said first switch means being adapted for actuation by said sequence control means;

said second switch means being adapted for actuation by said switch actuating member;

said switch actuating member having an off position and being operative to deactuate said second switch means when in its off position and to actuate said switch when not in its off position, said off position being arranged to correspond to the idle position of said segmental gear;

said sequence control means being operative to initiate the dispensing of a treating agent by actuating said first switch means for a time period sufficient to rotate said switch actuating member away from its off position but less than the period required for a complete revolution of said segmental gear whereby each rotational movement of said drive shaft is initiated by said controller and terminated by said switch actuating means.

9. The dispensing apparatus of claim 8 wherein said second switch means comprises a snap action switch having a pushbutton actuator, and said switch actuating means comprises cam means including an annular cam surface portion concentric with said drive shaft; and a radial groove portion adapted to receive said pushbutton actuator; said second switch means being mounted adjacent said cam means, said pushbutton actuator being adapted for depression by said cam surface portion and loosely received in said groove when said switch actuating means is in its off position, said cam surface being operative to depress said actuator thereby actuating said second switch means, and said groove portion being operative to release said actuator thereby deactuating said second switch means, whereby the rotation of said drive shaft is stopped by deactuation of said second switch means when said switch actuating means assumes its off position at the end of each revolution of said drive shaft to assure that each revolution is stopped at the same rotational position.

* * * * *